US012637247B2

(12) United States Patent
Lee et al.

(10) Patent No.: US 12,637,247 B2
(45) Date of Patent: May 26, 2026

(54) APPARATUS AND METHOD FOR FILLING CUSHIONING MEMBER

(71) Applicant: CJ LOGISTICS CORPORATION, Seoul (KR)

(72) Inventors: Hye Je Lee, Seoul (KR); Mu Kyun Park, Seoul (KR); Mun Seok Jang, Seoul (KR); Seong Yong Hyeong, Seoul (KR)

(73) Assignee: CJ LOGISTICS CORPORATION, Seoul (KR)

( * ) Notice: Subject to any disclaimer, the term of this patent is extended or adjusted under 35 U.S.C. 154(b) by 0 days.

(21) Appl. No.: 18/864,873

(22) PCT Filed: May 31, 2023

(86) PCT No.: PCT/KR2023/007422
§ 371 (c)(1),
(2) Date: Nov. 11, 2024

(87) PCT Pub. No.: WO2023/234692
PCT Pub. Date: Dec. 7, 2023

(65) Prior Publication Data

US 2025/0304303 A1 Oct. 2, 2025

(30) Foreign Application Priority Data

May 31, 2022 (KR) ..... 10-2022-0066574

(51) Int. Cl.
*B65B 57/12* (2006.01)
*B65B 5/10* (2006.01)
(Continued)

(52) U.S. Cl.
CPC ..... *B65B 57/12* (2013.01); *B65B 5/10* (2013.01); *B65B 59/001* (2019.05); *B65B 61/22* (2013.01)

(58) Field of Classification Search
USPC ..... 53/396
See application file for complete search history.

(56) References Cited

U.S. PATENT DOCUMENTS

2011/0308204 A1* 12/2011 Corradi ..... B65B 57/14 53/115
2017/0183139 A1* 6/2017 Wetsch ..... B65B 57/12

FOREIGN PATENT DOCUMENTS

JP 2016-159636 A 9/2016
KR 10-1151457 B1 6/2012
(Continued)

OTHER PUBLICATIONS

International search report.

*Primary Examiner* — Chinyere J Rushing-Tucker
(74) *Attorney, Agent, or Firm* — Harvest IP Law, LLP

(57) ABSTRACT

Disclosed is a cushioning member filling apparatus and method. The cushioning member filling apparatus according to the present invention may include: a sensor module for acquiring box space information having first space information about the entire space of a box with a set of goods loaded therein and second space information about a loading space occupied by the set of goods in the entire space of the box; a controller for producing a cushioning member making schedule and a cushioning member filling schedule according to the acquired box space information; a cushioning member maker for making cushioning members to be filled into the box according to the cushioning member making schedule; and a cushioning member filler for picking up the cushioning members received from the cushioning member maker and filling the cushioning members into the box according to the cushioning member filling schedule.

11 Claims, 13 Drawing Sheets

(51) Int. Cl.
*B65B 59/00* (2006.01)
*B65B 61/22* (2006.01)

(56) References Cited

FOREIGN PATENT DOCUMENTS

| | | |
|---|---|---|
| KR | 10-1899352 B1 | 9/2018 |
| KR | 10-2008149 B1 | 8/2019 |

* cited by examiner

【Figure 1】
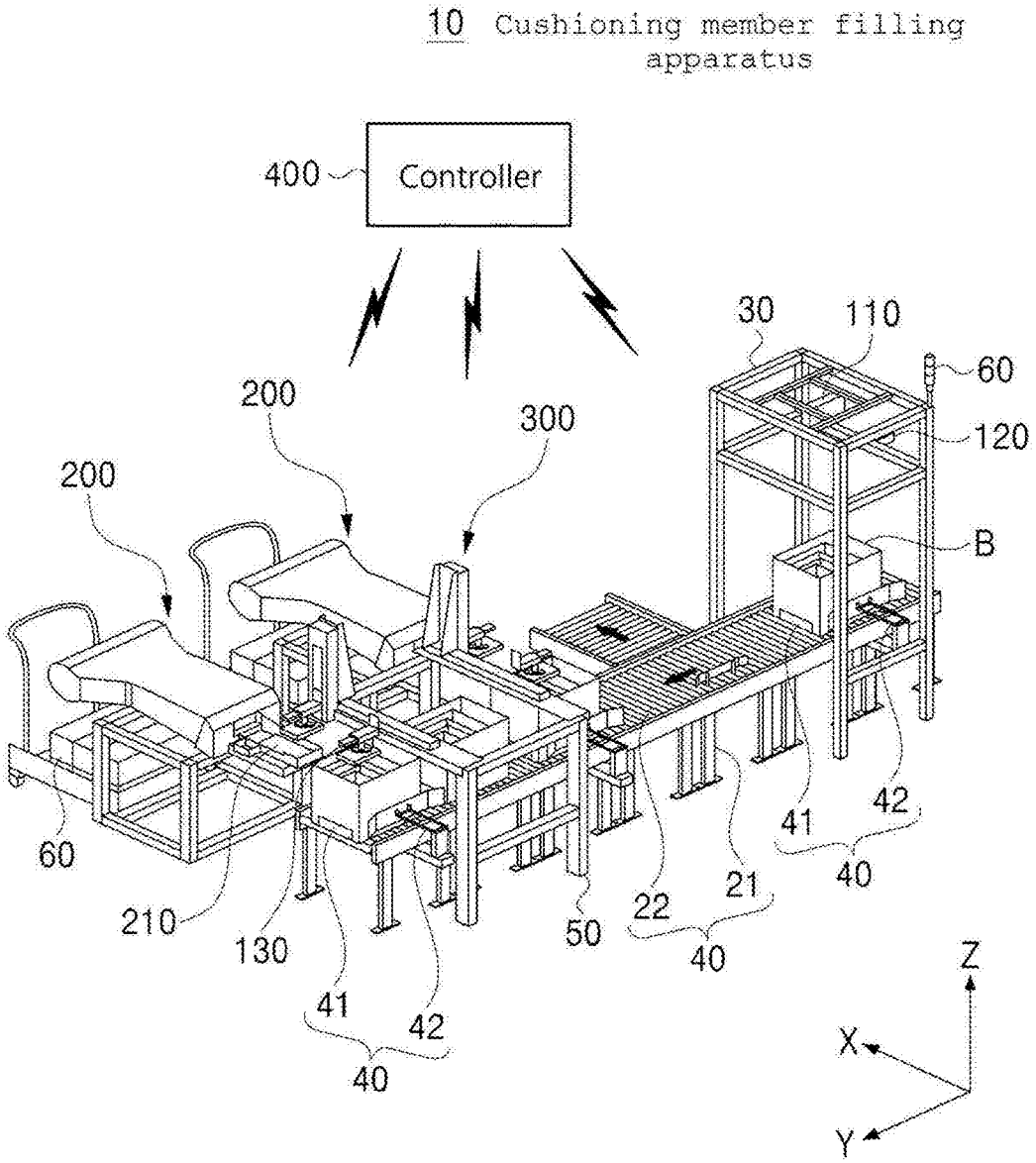

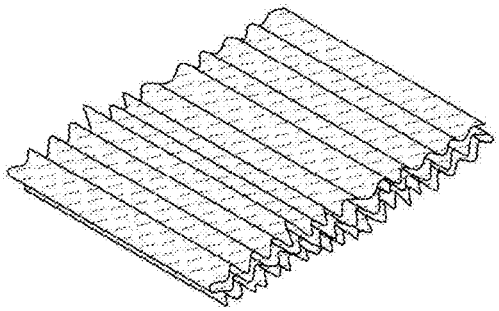
[Figure 2 (a)]
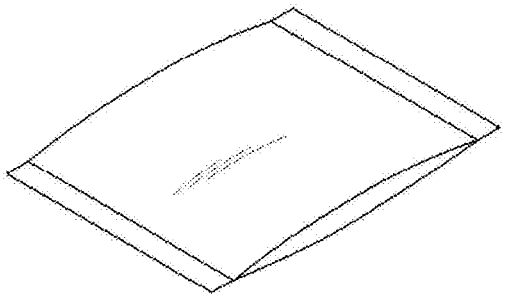
[Figure 2 (b)]

【Figure 3】
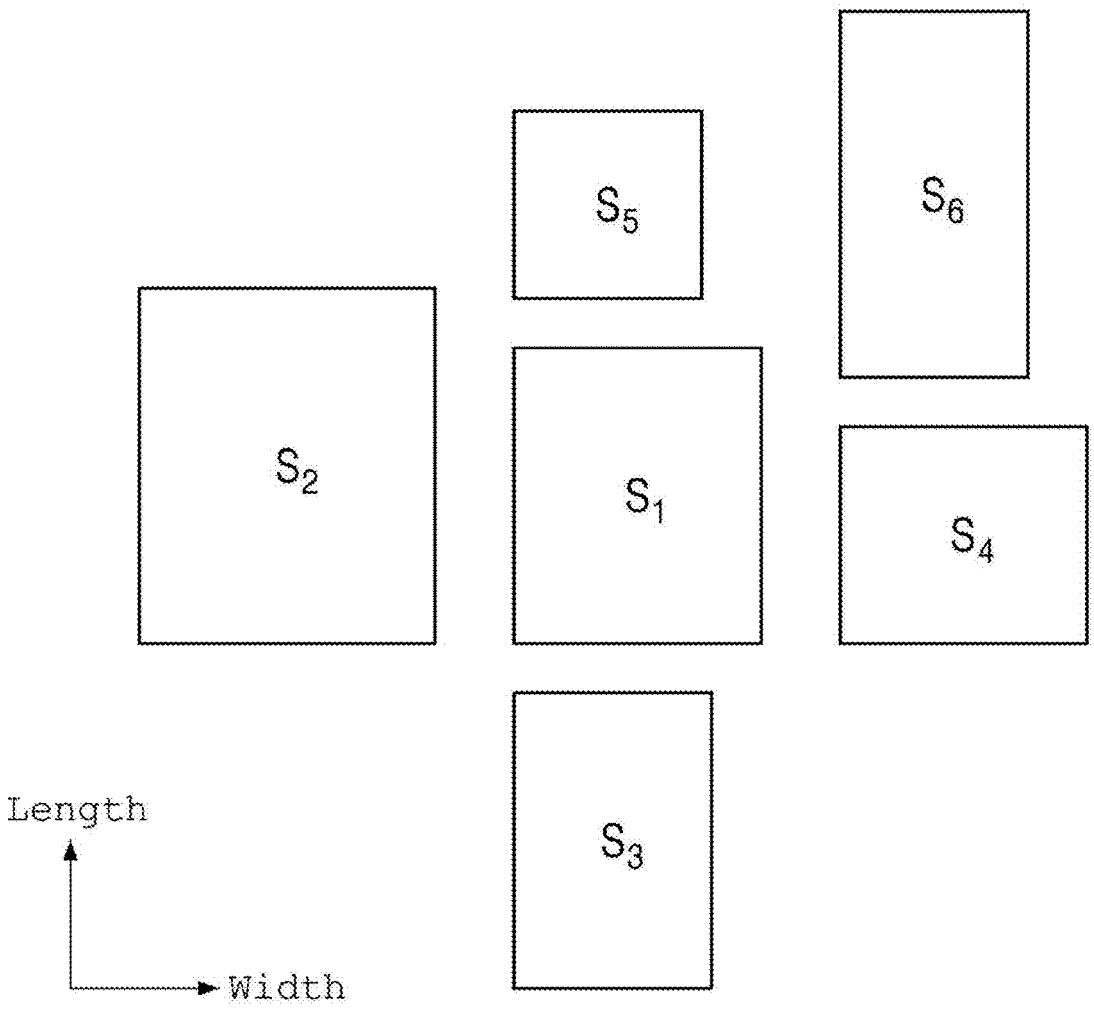

【Figure 4】
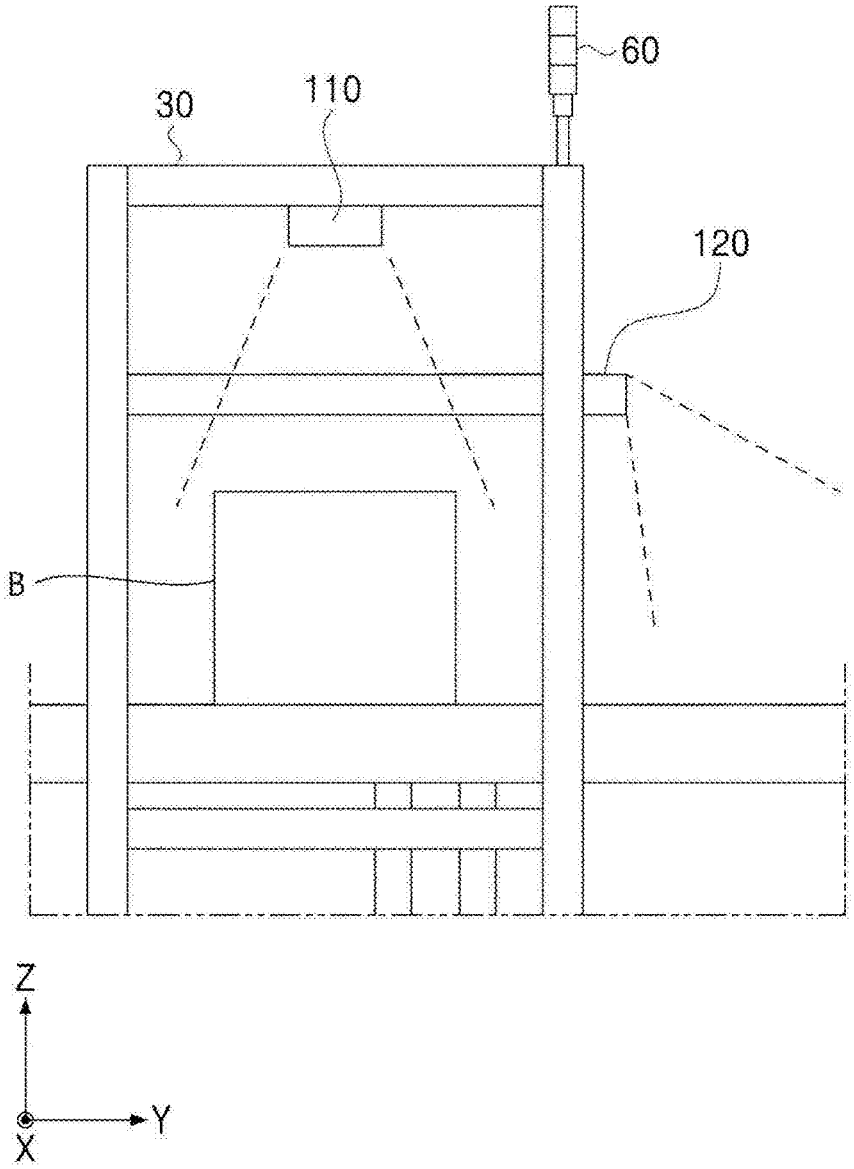

【Figure 5】
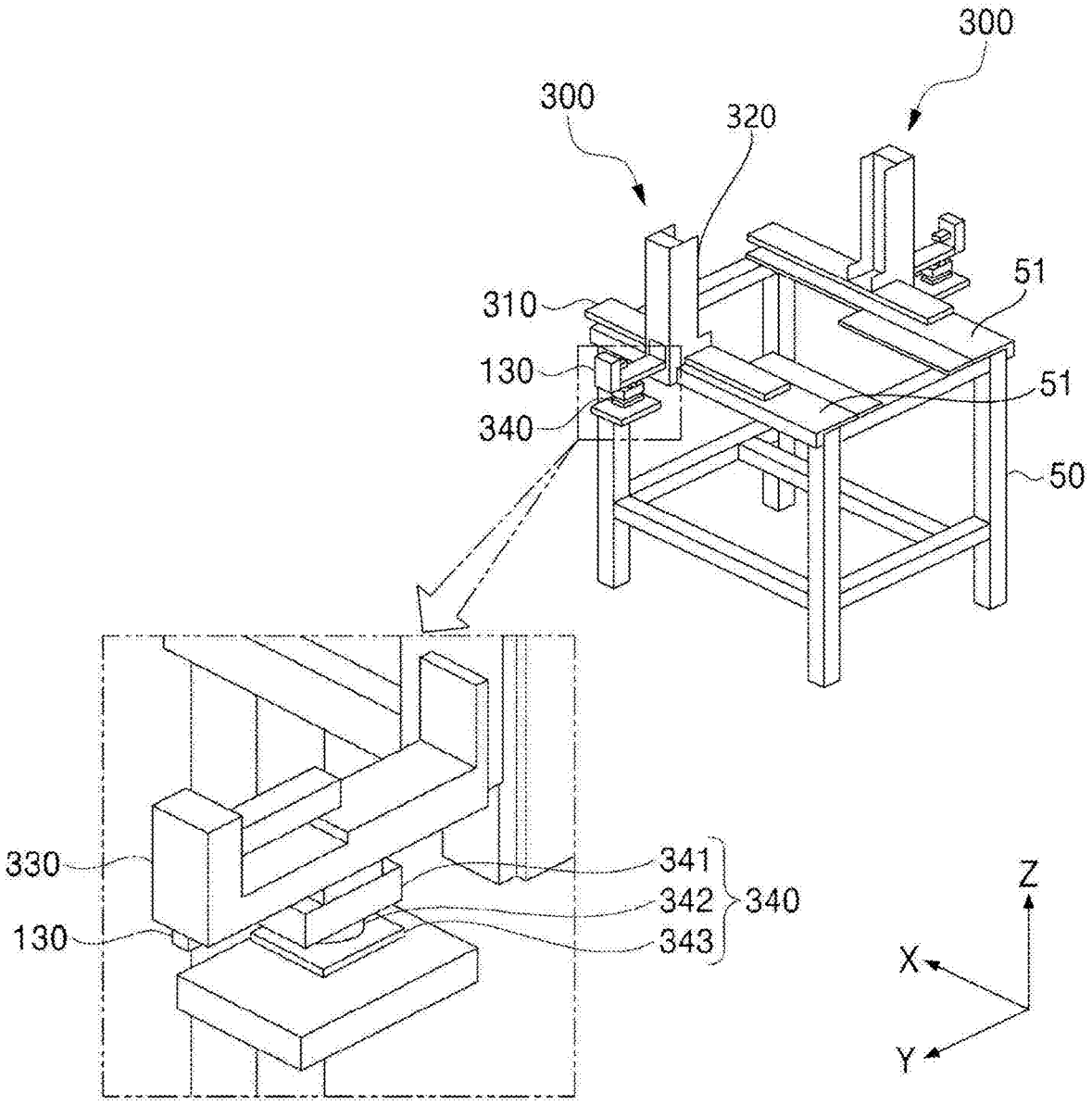

【Figure 6】
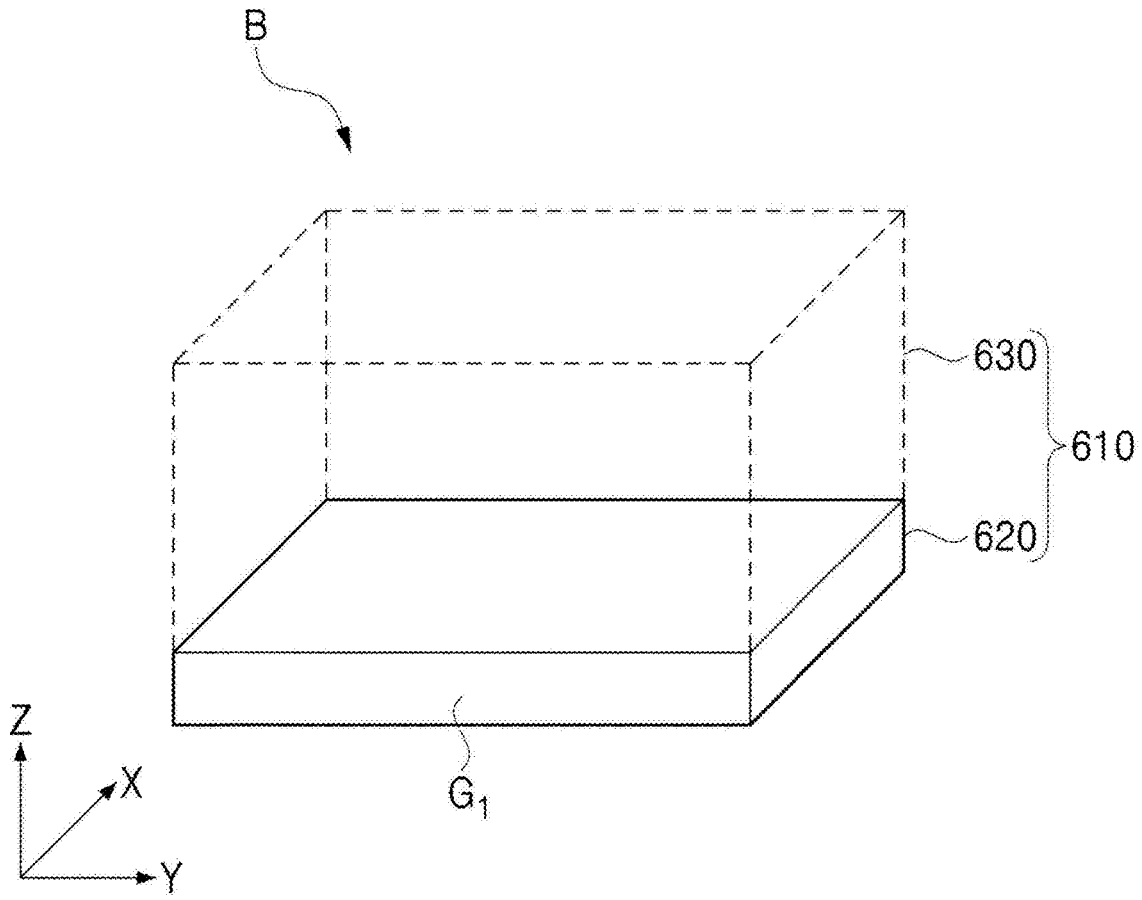

【Figure 7】
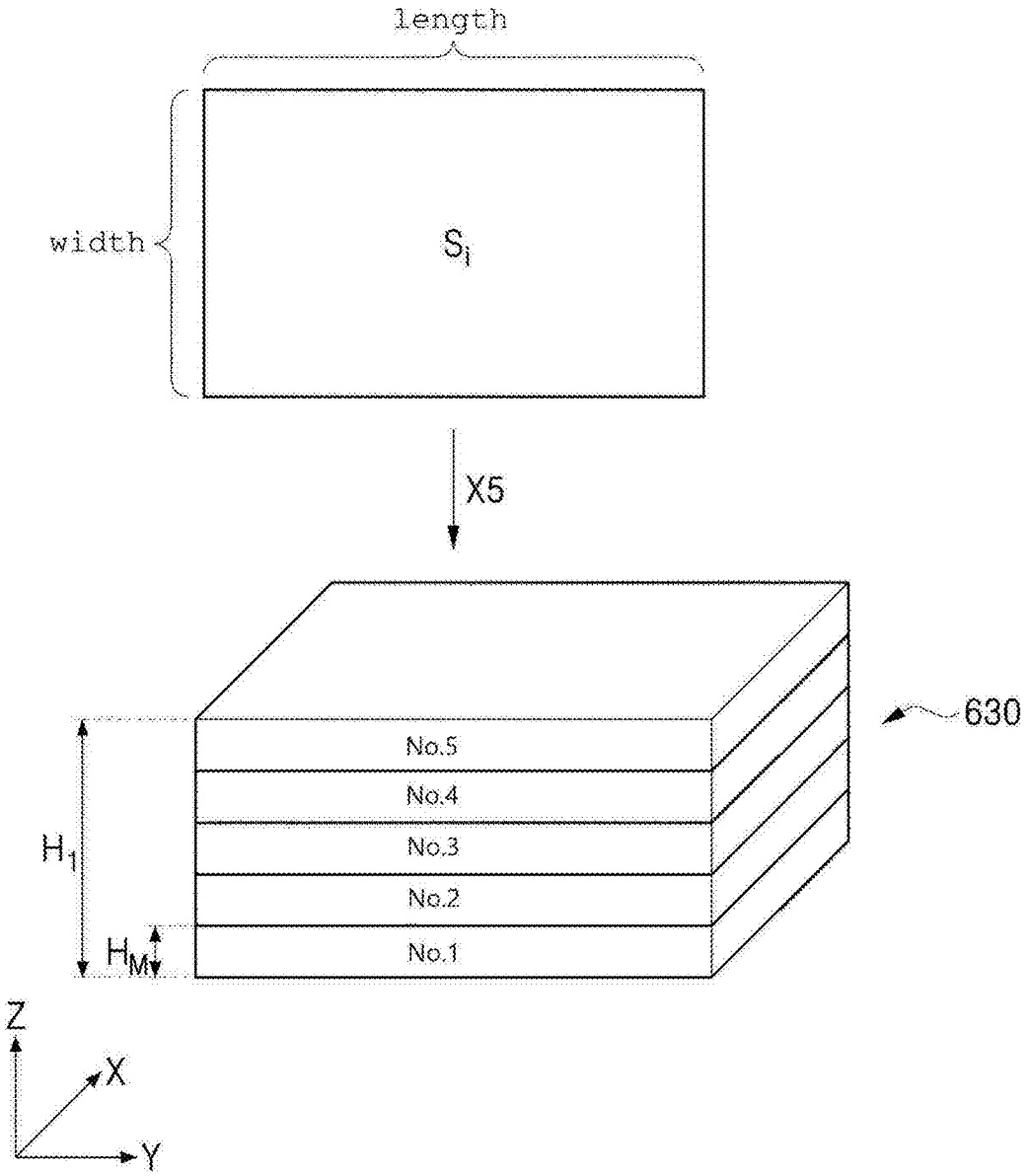

【Figure 8】
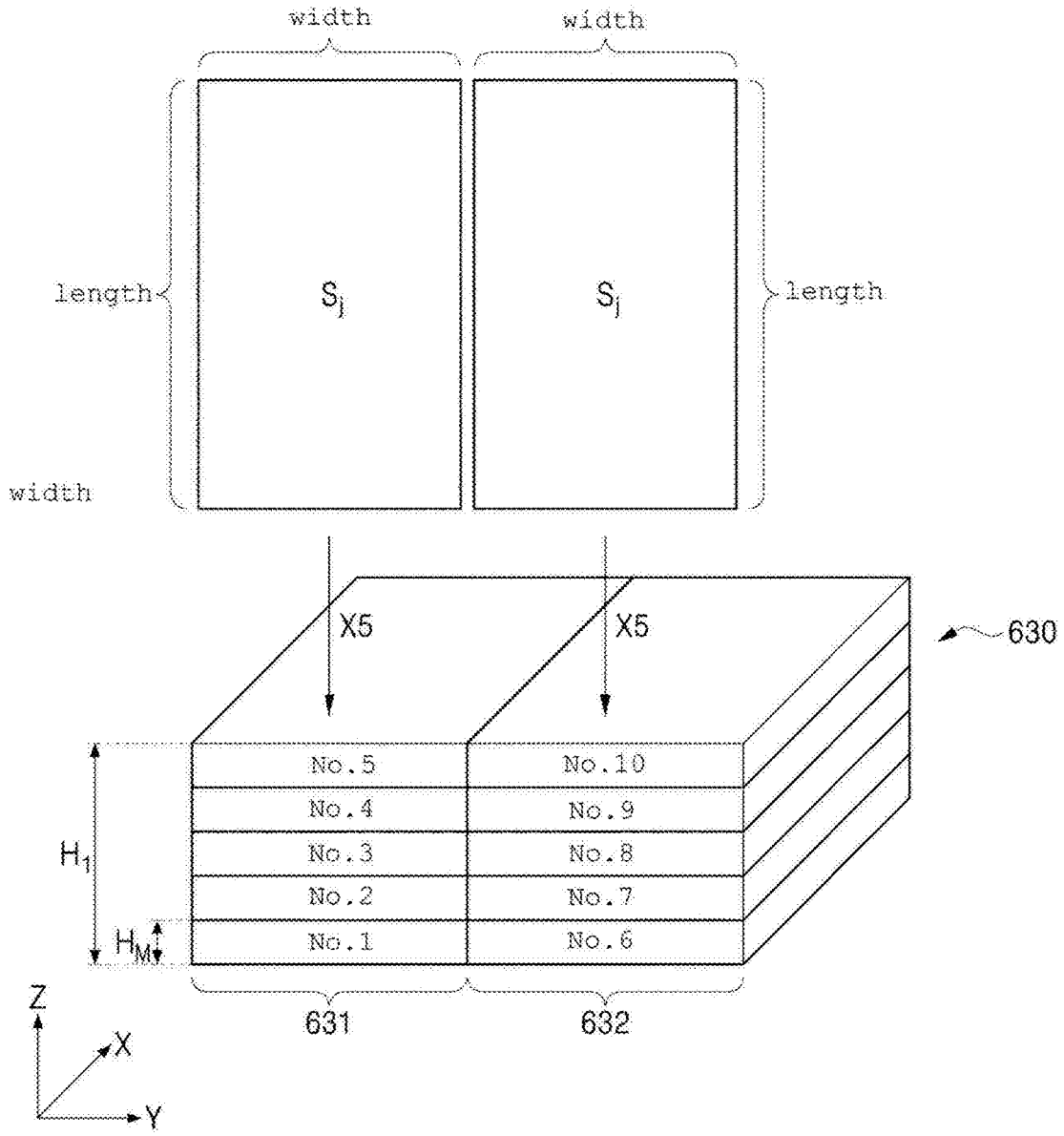

【Figure 9】
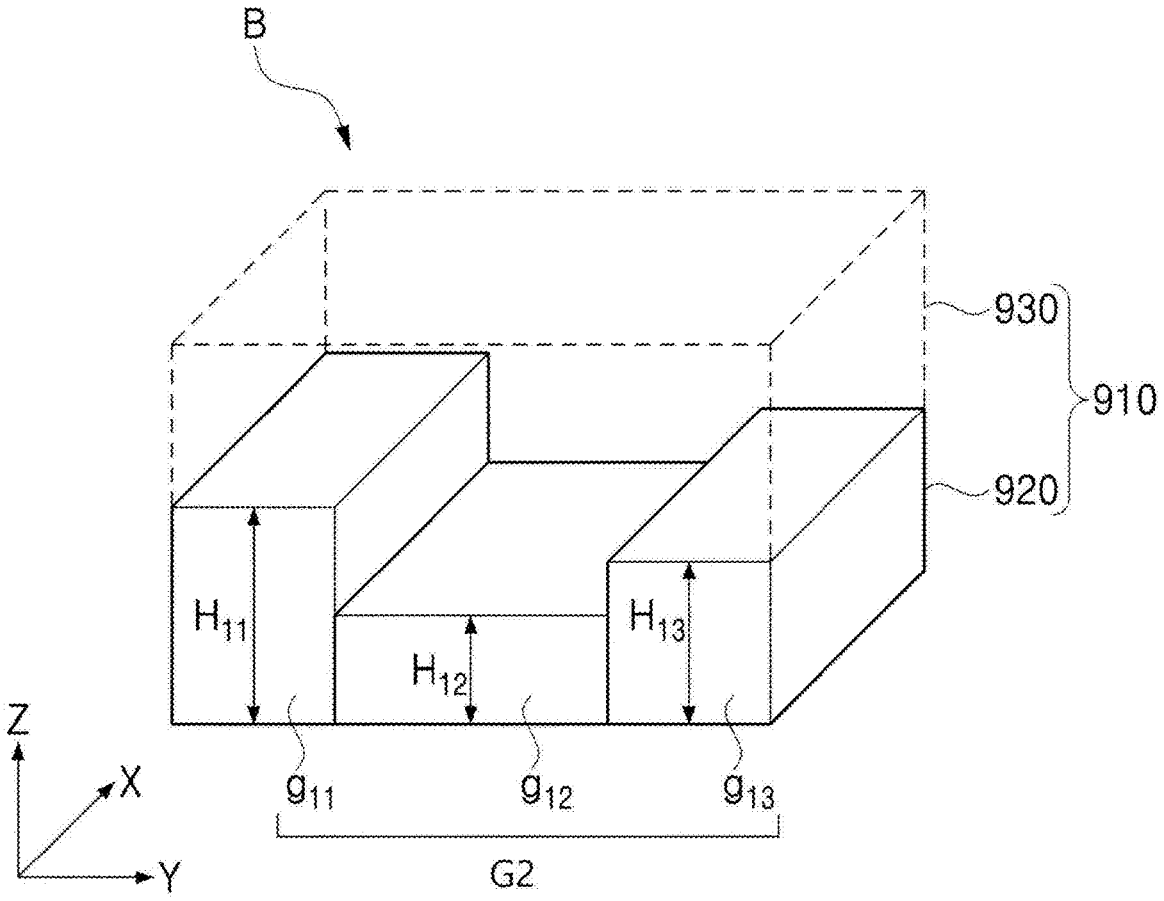

【Figure 10】
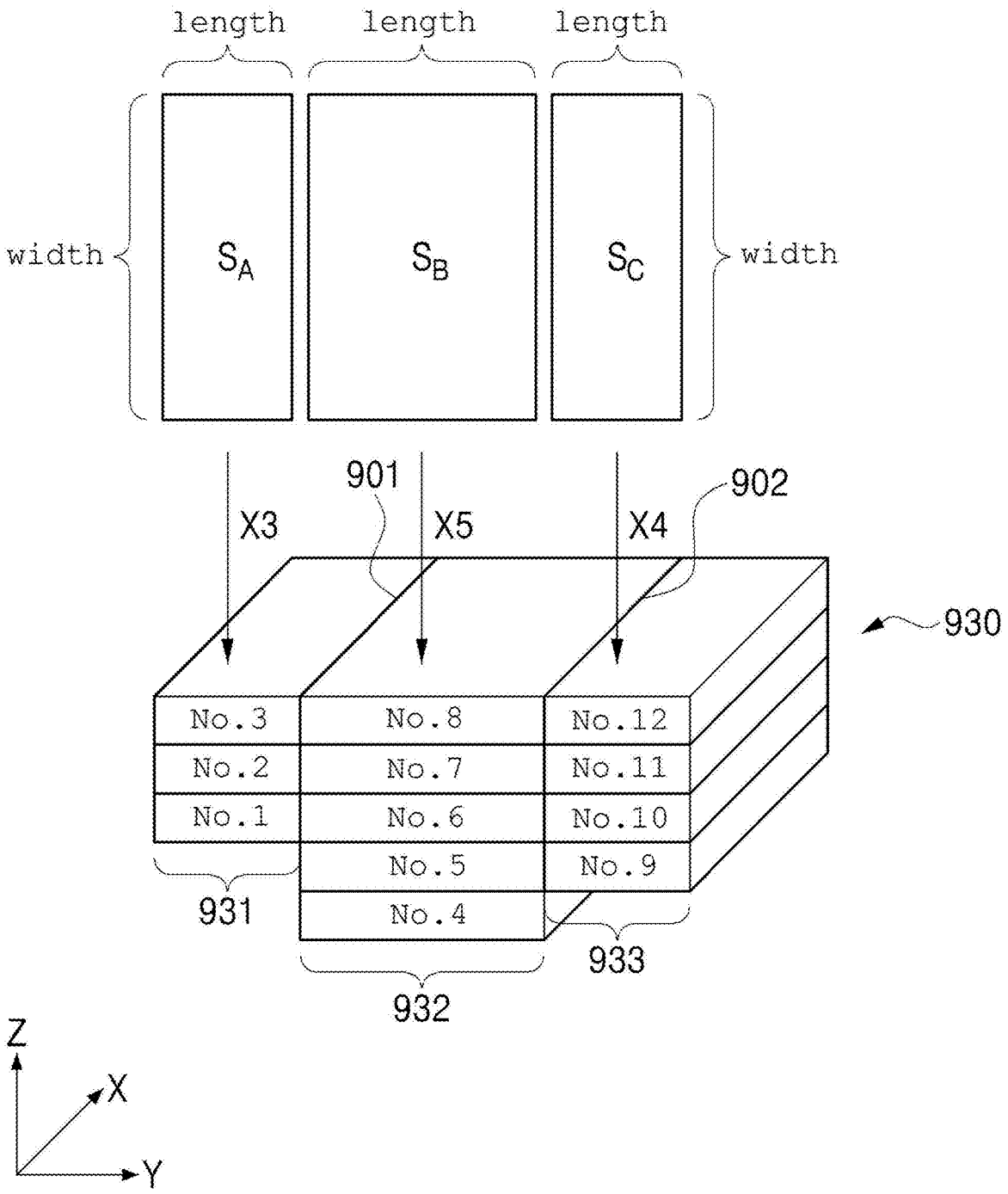

【Figure 11】
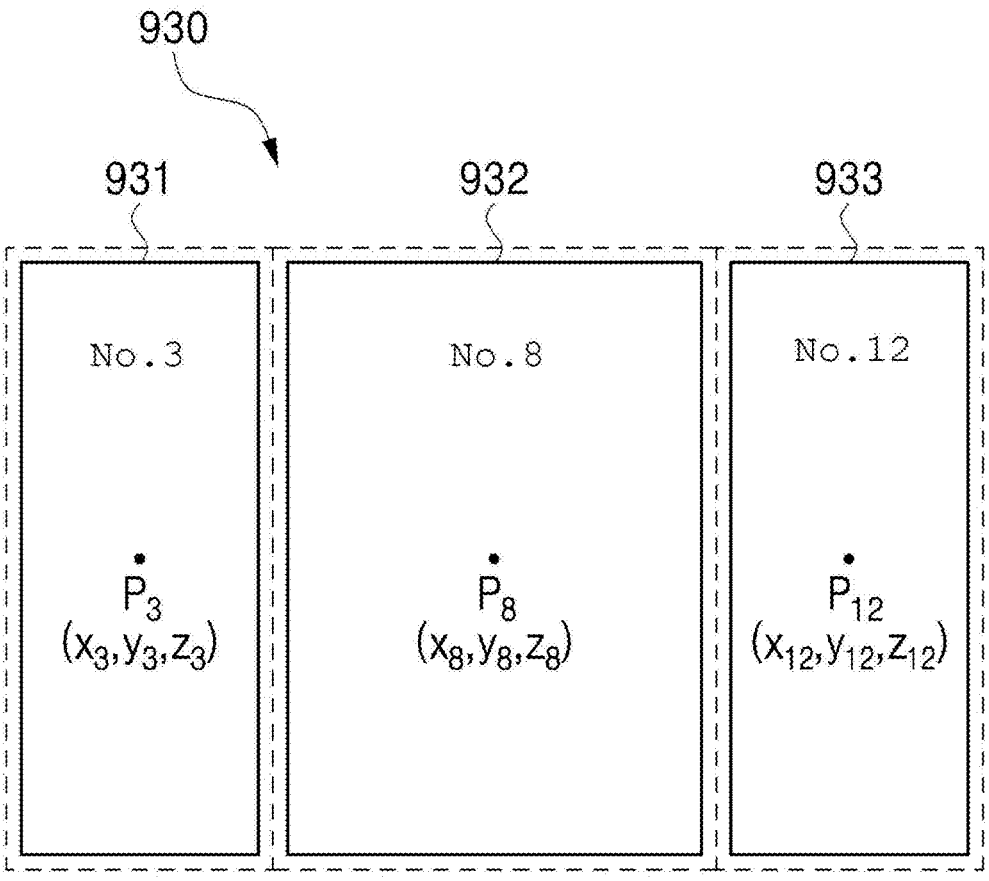

【Figure 12】
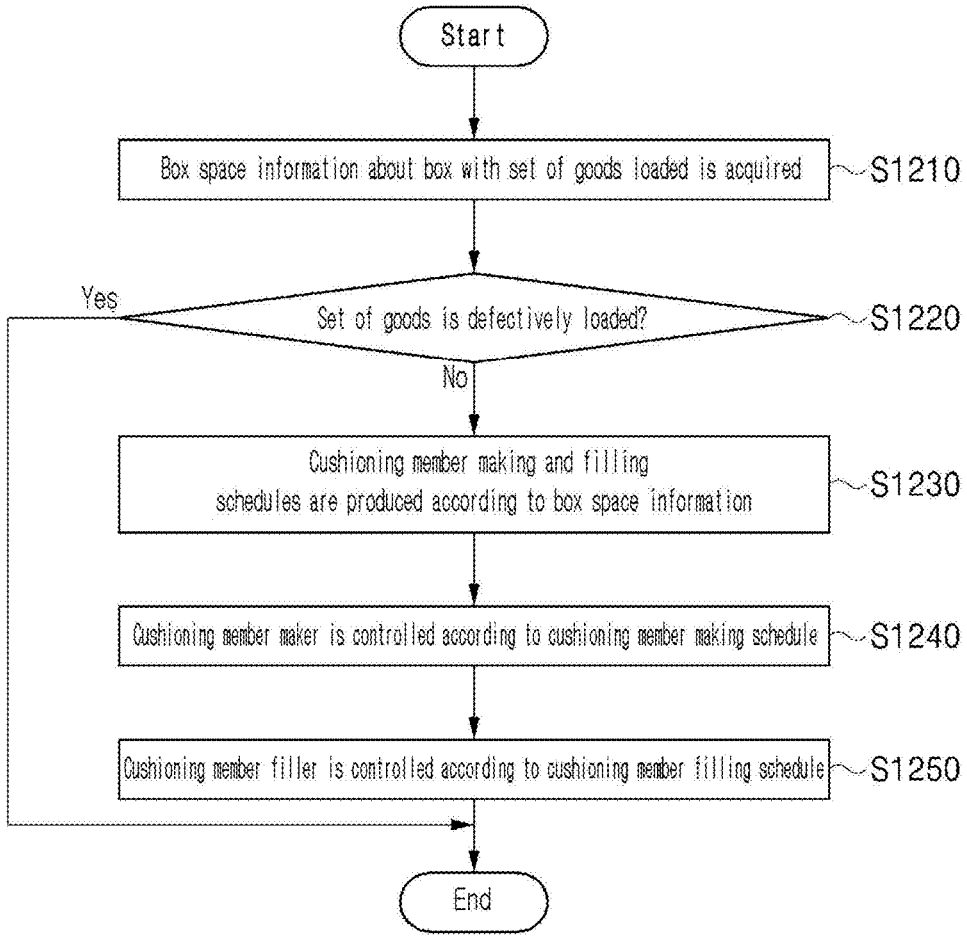

【Figure 13】
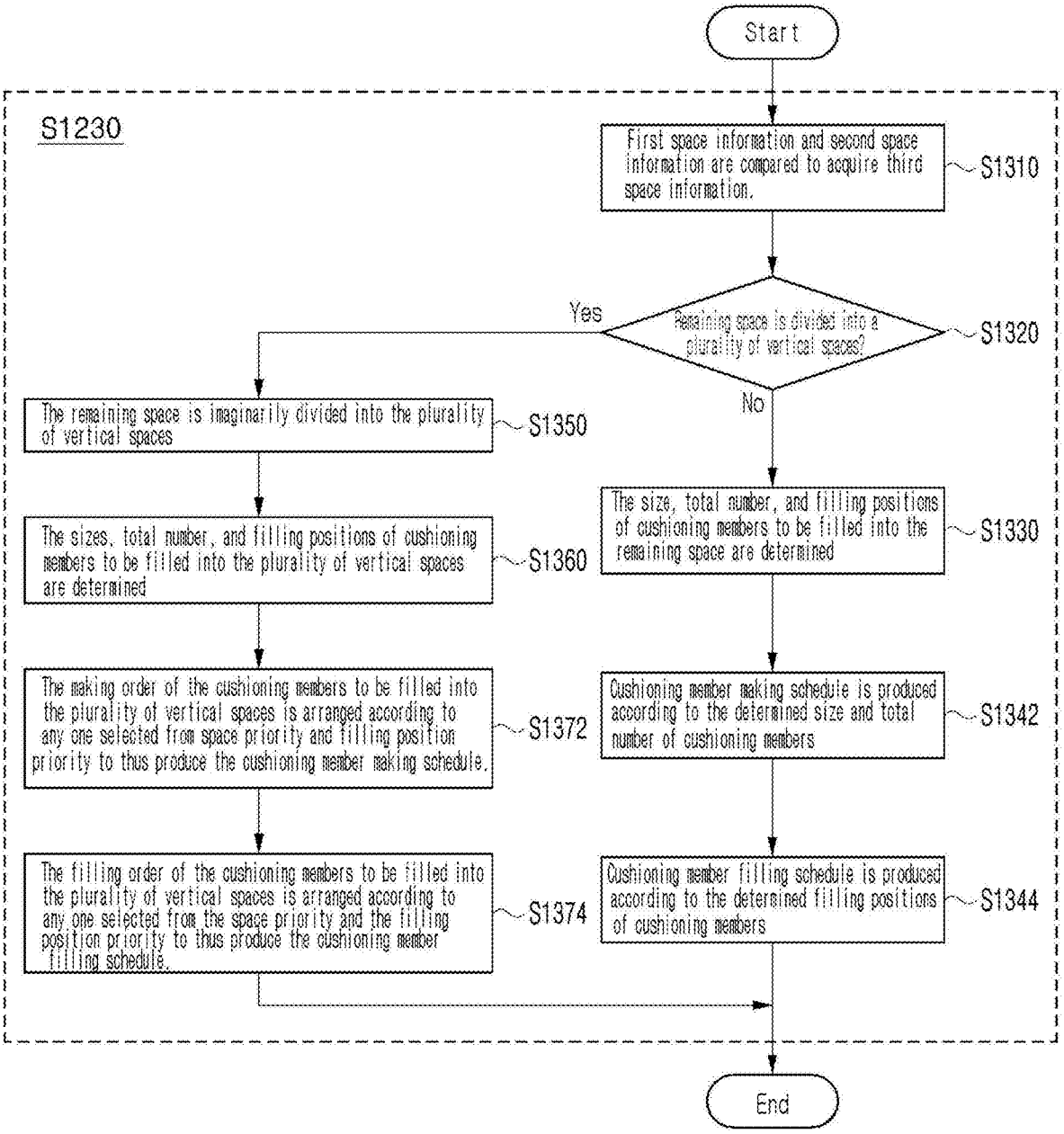

APPARATUS AND METHOD FOR FILLING CUSHIONING MEMBER

CROSS REFERENCE TO RELATED APPLICATION(S)

This application is a National Stage of International Application No. PCT/KR2023/007422 filed on May 31, 2023, claiming priority based on Korean Patent Application No. 10-2022-0066574 filed on May 31, 2022, the disclosures of which is incorporated herein by reference in their entireties.

TECHNICAL FIELD

The present invention relates to a cushioning member filling apparatus and method that is capable of being applied for the purpose of logistics management in a warehouse or the like to automatically make the cushioning members with sizes and number adequate to fill the remaining space of a box with a set of goods accommodated therein and thus automatically fill the cushioning members into the remaining space of the box.

BACKGROUND ART

As e-commerce markets have been explosively grown, recently, tries to enhance logistics management efficiencies through the application of logistics management systems to warehouses have been actively made.

To improve the logistics management efficiencies, there is a need to automatically perform cushioning member filling work for a box, but the cushioning member filling work is almost dependent upon only a worker's determination. In specific, in conventional practices, the worker checks the loading state of a set of goods in the box transported through a conveyor with the naked eye, and next, he or she fills an appropriate number of cushioning members into the remaining space of the box under his or her subjective determination.

However, the cushioning member filling work performed by the worker's manual operation has the following disadvantages. Firstly, the box packing process using the cushioning members is simple labor, and accordingly, there is a clear limitation in enhancing efficiency over a given level. Secondly, there is a big deviation in skills of workers, and accordingly, in the case of a beginner, he or she fills an excessively small number of cushioning members into the box or fills the cushioning members into an inappropriate position of the box, thereby undesirably making the goods accommodated in the box broken or damaged to frequently cause return issues. Contrarily, if an excessively large number of cushioning members are filled into the box, it is difficult to perform packing (sealing) work for sealing the open top surface of the box.

DISCLOSURE

Technical Problem

Accordingly, the present invention has been made in view of the above-mentioned problems occurring in the related art, and it is an object of the present invention to provide an apparatus and method for filling cushioning members that is capable of analyzing information about the entire space of a box and information about the loading space occupied by a set of goods accommodated into the box to automatically perform cushioning member filling work for the remaining space of the box.

It is another object of the present invention to provide an apparatus and method for filling cushioning members that is capable of making the cushioning members made of eco-friendly materials such as paper, not made of environmentally harmful materials such as air balls, plastics, vinyl, and the like, and filling the made cushioning members into a box.

The technical problems to be achieved through the present invention are not limited as mentioned above, and other technical problems not mentioned herein will be obviously understood to one of ordinary skill in the art through the following description.

Technical Solution

To accomplish the above-mentioned objects, according to one aspect of the present invention, there is provided a cushioning member filling apparatus including: a sensor module for acquiring box space information having first space information about the entire space of a box with a set of goods loaded therein and second space information about a loading space occupied by the set of goods in the entire space of the box; a controller for producing a cushioning member making schedule and a cushioning member filling schedule according to the acquired box space information; a cushioning member maker for making cushioning members to be filled into the box according to the cushioning member making schedule; and a cushioning member filler for picking up the cushioning members received from the cushioning member maker and filling the cushioning members into the box according to the cushioning member filling schedule.

The controller may compare the first space information with the second space information to acquire third space information about the remaining space obtained by removing the loading space from the entire space and thus produce the cushioning member making schedule and the cushioning member filling schedule according to the acquired third space information.

The controller may determine the size, total number, and filling positions of cushioning members to be filled into the remaining space according to the third space information and thus produce the cushioning member making schedule according to the determined size and total number of cushioning members and the cushioning member filling schedule according to the determined filling positions of cushioning members.

The controller may imaginarily divide the remaining space into a plurality of vertical spaces vertical with respect to top of the remaining space according to the third space information and thus determine the sizes, total number, and filling positions of cushioning members to be filled into the plurality of vertical spaces.

The controller may determine the total number of cushioning members to be filled into the plurality of vertical spaces according to the underside and top heights of the plurality of vertical spaces, determine the filling positions of cushioning members according to the underside and top heights and the center coordinates of the plurality of vertical spaces, and determine the sizes of cushioning members to be filled into the plurality of vertical spaces according to the widths and lengths of the plurality of vertical spaces.

The controller may arrange making commands representing the sizes and total number of cushioning members determined for the plurality of vertical spaces according to space identification numbers applied to the plurality of vertical spaces to thus produce the cushioning member making schedule.

The controller may arrange filling commands representing the total number and filling positions of cushioning members determined for the plurality of vertical spaces according to the space ID numbers applied to the plurality of vertical spaces to thus produce the cushioning member filling schedule.

The controller may arrange the sizes of the cushioning members to be filled into the plurality of vertical spaces according to the height values of the filling positions of the cushioning members into the plurality of vertical spaces to thus produce the cushioning member making schedule.

The controller may arrange the filling positions of the cushioning members to be filled into the plurality of vertical spaces according to the height values of the filling positions of the cushioning members into the plurality of vertical spaces to thus produce the cushioning member filling schedule.

The cushioning members may be made of eco-friendly materials and have a plurality of sizes different in at least one of length and width.

The sensor module may include: a first sensor adapted to recognize box codes marked on the outer surface of the box and thus acquire the first space information; and a second sensor adapted to capture an image of the interior of the box and thus acquire the second space information.

To accomplish the above-mentioned objects, according to another aspect of the present invention, there is provided a cushioning member filling method including the steps of: acquiring box space information having first space information about the entire space of a box with a set of goods loaded therein and second space information about a loading space occupied by the set of goods in the entire space of the box; producing a cushioning member making schedule and a cushioning member filling schedule according to the acquired box space information; controlling a cushioning member maker to make cushioning members to be filled into the box according to the cushioning member making schedule; and controlling a cushioning member filler to pick up the cushioning members received from the cushioning member maker and thus fill the cushioning members into the box according to the cushioning member filling schedule.

The step of producing the cushioning member making schedule and the cushioning member filling schedule may include the steps of: comparing the first space information with the second space information to acquire third space information about the remaining space obtained by removing the loading space from the entire space; determining the size, total number, and filling positions of cushioning members to be filled into the remaining space according to the third space information; producing the cushioning member making schedule according to the determined sizes and total number of cushioning members; and producing the cushioning member filling schedule according to the determined filling positions of cushioning members.

The step of producing the cushioning member making schedule and the cushioning member filling schedule may include the steps of: comparing the first space information with the second space information to acquire third space information about the remaining space obtained by removing the loading space from the entire space; imaginarily dividing the remaining space into a plurality of vertical spaces vertical with respect to top of the remaining space; and determining the sizes, total number, and filling positions of cushioning members to be filled into the plurality of vertical spaces.

The step of producing the cushioning member making schedule and the cushioning member filling schedule may further include the steps of: arranging making commands representing the sizes and total number of cushioning members determined for the plurality of vertical spaces according to space identification numbers applied to the plurality of vertical spaces to thus produce the cushioning member making schedule; and arranging filling commands representing the total number and filling positions of the cushioning members determined for the plurality of vertical spaces according to the space identification numbers applied to the plurality of vertical spaces to thus produce the cushioning member filling schedule.

The step of producing the cushioning member making schedule and the cushioning member filling schedule may further include the steps of: arranging the sizes of cushioning members to be filled into the plurality of vertical spaces according to the height values of the filling positions of the cushioning members into the plurality of vertical spaces to produce the cushioning member making schedule; and arranging the filling positions of the cushioning members to be filled into the plurality of vertical spaces according to the height values of the filling positions of the cushioning members into the plurality of vertical spaces to produce the cushioning member filling schedule.

Advantageous Effects

According to at least one of the embodiments of the present invention, the information about the entire space of the box and the information about the loading space occupied by the set of goods accommodated into the box are analyzed to acquire the information about the remaining space of the box representing the space in which the cushioning members are fillable, and next, the sizes, total number, filling positions, and making and filling order of cushioning members to be filled into the remaining space of the box are determined through computing means according to the size (width, length, height, and volume) of the remaining space. Therefore, the problems caused under only the worker's individual determination in the existing work can be substantially removed.

According to at least one of the embodiments of the present invention, further, the process of making the cushioning members to be filled into the remaining space of the box is automatically performed, and even the process of filling the made cushioning members is automatically performed. Therefore, a labor cost required for the cushioning member filling work can be reduced, and further, the filled states of the cushioning members can be proper and uniform, while the filling workability is being greatly improved.

According to at least one of the embodiments of the present invention, furthermore, the cushioning members are made of eco-friendly materials such as paper, not made of environmentally harmful materials such as air balls, plastics, vinyl, and the like.

According to at least one of the embodiments of the present invention, further, in the case where it is difficult to fill the cushioning members at once into the entire remaining space of the box, the remaining space is imaginarily divided into the plurality of vertical spaces having the same shape and volume as one another or different shapes and volumes, and the sizes, total number, filling positions, and filling order of cushioning members to be filled into the plurality of vertical spaces are determined, thereby quickly performing the cushioning member making and filling processes.

The effectiveness of the invention is not limited as mentioned above, and it should be understood to those skilled in the art that the effectiveness of the invention may include another effectiveness as not mentioned above from the detailed description of the present invention.

DESCRIPTION OF DRAWINGS

The following drawings herein illustrate preferred embodiments of the present invention and serve to facilitate the general understanding of the scope of the present invention, together with the detailed description of the present invention. Therefore, the present invention is not limitedly interpreted only with the attached drawings.

FIG. 1 is a perspective view showing a cushioning member filling apparatus according to the present invention.

FIG. 2 (*a*) and FIG. 2 (*b*) are a perspective view showing types of cushioning members manufacturable by a cushioning member maker of the cushioning member filling apparatus according to the present invention.

FIG. 3 is an exemplary view showing cushioning members with various sizes manufacturable by a multisize type cushioning member maker of the cushioning member filling apparatus according to the present invention.

FIG. 4 is a side view showing a process of acquiring box space information according to the present invention.

FIG. 5 is a perspective view showing cushioning member fillers of FIG. 1.

FIG. 6 is a perspective view showing an example of the remaining space of the box acquired using the box space information according to the present invention.

FIGS. 7 and 8 are views showing scheduling processes of making and filling the cushioning members for the remaining space having a constant underside height.

FIG. 9 is a perspective view showing another example of the remaining space of the box space acquired using the box space information according to the present invention.

FIGS. 10 and 11 are views showing scheduling processes of making and filling cushioning members in the case where the remaining space is imaginarily divided into a plurality of vertical spaces having different underside heights.

FIG. 12 is a flowchart showing a method for filling cushioning members according to the present invention.

FIG. 13 is a flowchart showing a process of producing a cushioning member making schedule and a cushioning member filling schedule according to the present invention.

MODE FOR INVENTION

Objects, characteristics and advantages of the present invention will be more clearly understood from the detailed description as will be described below and the attached drawings. Hereinafter, the present invention will be disclosed in detail with reference to the attached drawings.

The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

Functional blocks as will be indicated in the drawings and discussed in the description are just examples according to the present invention. Other functional blocks may be used as other examples according to the present invention within the whole scope of the present invention. According to the present invention, further, one or more functional blocks are indicated as individual blocks, but they may become combinations of various hardware and software executing the same function as each other.

Terms, such as the first, and the second, may be used to describe various elements, but the elements should not be restricted by the terms. The terms are used to only distinguish one element from the other element.

In the description, when it is said that one portion is described as "includes" any component, one element further may include other components unless no specific description is suggested.

When it is said that one element is described as being "connected" or "coupled" to the other element, one element may be directly connected or coupled to the other element, but it should be understood that another element may be present between the two elements.

FIG. 1 is a perspective view showing a cushioning member filling apparatus according to the present invention.

Referring to FIG. 1, a cushioning member filling apparatus 10 according to the present invention is configured to fill cushioning members for damage prevention into a box B in the case where the box B in which a set of goods is accommodated (loaded) is transported in a warehouse and the like. The box B, which is transported to the cushioning member filling apparatus 10, may have different sizes (widths, lengths, and heights).

The cushioning member filling apparatus 10 largely includes a sensor module 100, cushioning member makers 200, cushioning member fillers 300, and a controller 400.

The underside of the box B transported in a state of loading the set of goods therein is spaced apart from the floor by a given height by means of a box supporter 20. In specific, the box supporter 20 is a kind of a support stand that is configured to extend by a given length, while having a larger width than the maximum width of the box B, to allow the underside of the box B to be spaced apart from the given height from the floor.

A conveyor may be used as the box supporter 20. The conveyor as the box supporter 20 includes support frames 21 and transporters 22, and further, the conveyor includes at least one or more arrangement mechanisms 40.

The support frames 21 are structures for allowing the transporters 22 to be spaced apart from the floor by a given distance.

The transporters 22 are coupled to the support frames 21 and thus come into direct contact with the underside of the box B to apply support forces to the box B. The transporters 22 include a plurality of transport rollers rotating by means of a drive source such as a motor to transport the box B along a transport path.

Each arrangement mechanism 40 includes a box detector (not shown), a stopper 41, and aligners 42. The box detector detects the existence of the box B at a specific position on the transport path of the box B by means of the transporters 22 and outputs a box detection signal. The box detector is additionally provided, but a first sensor 110 as will be discussed later may be utilized for the box detector. In a normal situation (where the box B is not detected), the stopper 41 is descended under the transporters 22, and if the box detection signal is generated, the stopper 41 is ascended above the transport rollers. Even though the transport rollers are rotating, accordingly, the stopper 41 comes into contact with one side of the front surface of the box B to stop the forward movement of the box B. If a single box B is disposed on the box supporter 20, the transporters 22 stop rotations of the transport rollers in response to the box detection signal.

The aligners 42 reciprocate along an X-axis, and in the normal situation, the aligners 42 move back to given positions outwardly from the box support frames 21, and they move forward toward both sides of the box B stopped by the stopper 41. Accordingly, both sides of the box B are aligned to given angles (e.g., vertically) with respect to the transport direction thereof. Moving quantities of the aligners 42 to the X-axis before and after the box detection are based on first space information (particularly, the width of the box) acquired by the sensor module 100 as will be discussed later. Each aligner 42 has a pressure gauge mounted thereon to limit the forward moving distance thereof so that the pressure applied from the aligner 42 to the box B is kept within a given range.

The arrangement mechanisms 40 are located on a first area and a second area. The first area is the area in which the box space information is acquired from the box B. As the box B is aligned through the arrangement mechanism 40 located on the first area, the box space information corresponding to the real state of the box B is acquired on the first area. The second area is the area in which a cushioning member filling process for the box B passing through the first area along a Y-axis is carried out. As the box B is aligned through the arrangement mechanism 40 located on the second area, the cushioning member filling process based on the box space information acquired on the first area is appropriately carried out on the second area.

The sensor module 100 serves to sense the box B and thus acquire the box space information from the box B. The sensor module 100 includes the first sensor 110 and a second sensor 120, and further, it may include a third sensor 130.

The first sensor 110 serves to acquire the first space information about the entire space of the box B. For example, the first sensor 110 is a code scanner that recognizes box codes marked on the outer surface of the box B and thus acquires the first space information. The box codes are directly printed on the outer surface of the box B or attached to the outer surface of the box B in a state of being printed on a box label such as a sticker. On the box codes, the dimension (size) information of the box B is recorded in the form of barcodes or QR codes. The dimension information of the box B represents the width, length and height of the box B and additionally includes the volume, material, and strength (durability) of the box B. For the sake of understanding, it is assumed that the width of the box B is a size in the direction of the X-axis, the length a size in the direction of the Y-axis, and the height a size in the direction of a Z-axis.

The second sensor 120 serves to acquire second space information about the loading space of the box B. In this case, the loading space is the space occupied by the set of goods in the entire space of the box B. For example, the second sensor 120 includes a three-dimensional camera that captures an image of the interior of the box B and thus acquires, as the second space information, vision data such as image or video representing three dimensional characteristics of the loading space.

The third sensor 130 is coupled to a gripper 340 of the cushioning member filler 300 as will be discussed later, and in a state where the cushioning member filler 300 moves the cushioning member to X and Y coordinates of a filling position of the cushioning member, thus detects a vertical distance from the cushioning member to a loading height in the box B located vertically under the cushioning member. For the reference, the loading height in the specific space within the box B is equal to a height of goods before the cushioning member is filled, and when the cushioning members are filled one by one, the loading height increases by heights of the cushioning members filled. The cushioning members, which are made by each cushioning member maker 200, may have given tolerances from their original sizes, and before the cushioning member is directly moved vertically downwardly in a state of being transported to the X and Y coordinates of the filling position thereof, accordingly, the vertical distance between the cushioning member and the real loading height is detected. As a result, a value of the Z-axis of the filling position of the cushioning member is adjusted so that the value of the Z-axis is greater than or equal to the loading height and a difference value between the value of the Z-axis and the loading height is less than or equal to a threshold value. Accordingly, the pre-loaded goods or cushioning members can be prevented from being damaged and broken due to the situation where the value of the Z-axis of the filling position of the cushioning member is lower than the threshold value. Further, the falling distance of the cushioning member can be prevented from extending due to the situation where the value of the Z-axis of the filling position of the cushioning member is higher than the threshold value.

Each cushioning member maker 200 is configured to allow a cushioning material sheet fed to an inlet thereof in wound, laminated, or zigzag form to be made as the cushioning member through given processing and molding to thus discharge the cushioning member to an outlet thereof. The cushioning material sheet is made of, for example, an eco-friendly material such as paper and the like.

The cushioning member maker 200 is a single size type maker for making the cushioning member with a single size and a multisize type maker for making the cushioning members having the sizes required by the controller 400 among a plurality of different sizes.

Each cushioning member filler 300 serves to pick up the cushioning member received from the outlet of the cushioning member maker 200 and thus fill (accommodate or load) the cushioning member in a designated position within the box B. An explanation of the cushioning member filler 300 will be given in more detail later with reference to FIG. 5.

The controller 400 is connected to the sensor module 100, the cushioning member makers 200, and the cushioning member fillers 300, and accordingly, the controller 400 transmits and receives signals/information to and from the sensor module 100, the cushioning member makers 200, and the cushioning member fillers 300.

FIG. 2 is a perspective view showing types of cushioning members manufacturable by the cushioning member maker of the cushioning member filling apparatus according to the present invention, and FIG. 3 is an exemplary view showing cushioning members with various sizes manufacturable by the multisize type cushioning member maker of the cushioning member filling apparatus according to the present invention.

Referring to FIG. 2, the cushioning member has any one of a corrugated pad form and a pack form or a combination thereof.

The cushioning member in the corrugated form as shown in FIG. 2*a* is made by passing the cushioning material sheet 60 through a corrugation hole formed inside the cushioning member maker 200, processing the cushioning material sheet 60 to the form of a regularly or irregularly corrugated pad, and cutting the processed corrugated pad, so that the corrugated pad has a width smaller than the cushioning material sheet 60.

The cushioning member in the pack form as shown in FIG. 2*b* is made by cutting the cushioning material sheet 60 to have a top sheet and an underside sheet with the same size as each other, sealing at least portions of the outer edges of the top sheet and the underside sheet facing each other by means of an adhesive, and sealing the remaining portions of the outer edges in a state of injecting air into the sealed internal space to provide a cushioning space therein.

The cushioning member having the corrugated pad form or the pack form has the shape of a rectangular parallelepiped. Hereinafter, an explanation will be given under it is assumed that the cushioning member has the shape of the rectangular parallelepiped.

The plurality of sizes are pre-defined so that at least one of the width and length of one box is different from at least one of the width and length of another box. In specific, any one size is different only in width or length or in both of width and length from at least one of other sizes. The heights of the plurality of sizes are the same as one another. As shown in FIG. 3, when a size S1 and a size S2 are compared with each other, the width and length of the size S2 are longer than those of the size S1. When the size S1 and a size S3 are compared with each other, the width of the size S3 is shorter than that of the size S1, but the length of the size S3 is equal to that of the size S1. When the size S1 and a size S4 are compared with each other, the length of the size S4 is shorter than that of the size S1, but the length of the size S4 is equal to that of the size S1. When the size S1 and a size S5 are compared with each other, the width and length of the size S5 are shorter than those of the size S1. When the size S1 and a size S6 are compared with each other, the width of the size S6 is shorter than that of the size S1, but the length of the size S6 is equal to that of the size S1.

FIG. 4 is a side view showing a process of acquiring box space information according to the present invention.

Referring to FIG. 4, the first sensor 110 and the second sensor 120 of the sensor module 100 are coupled to different positions from each other of a sensor support frame 30 located on the first area. As shown in FIG. 4, the sensor support frame 30 includes support posts extending straightly along the direction of the Z-axis and thus located vertically with respect to the floor and reinforcing members for connecting sets of two support posts to each other.

The first sensor 110 is located to recognize the box codes marked on the box B. The second sensor 120 is coupled to the reinforcing member located on the central portion of the upper side of the sensor support frame 30 to capture an image of the interior of the box B.

The box codes are recognized through the first sensor 110 to acquire the first space information about the entire space of the box B, and in a state where the box B is aligned through the aligners 42 located on the first area, further, the image of the interior of the box B is captured through the second sensor 120 to acquire the second space information about the loading space.

The controller 400 sets a box area corresponding to a real top size of the box B in the entire area of the image of the box B outputted from the second sensor 120, based on the first space information. Accordingly, an image area whose analysis is required to extract the second space information about the loading space is reduced to the box area, thereby making it possible to quickly acquire the second space information.

FIG. 5 is a perspective view showing the cushioning member fillers of FIG. 1.

Referring to FIG. 5, the cushioning member fillers 300 are coupled to a robot support frame 50 located on the second area and supportedly located above the box support surface of the box supporter 20 in the direction of the Z-axis.

The robot support frame 50 is spaced apart from the transporters 22 on the second area and has at least or more one support plates 51 to which the at least one or more cushioning member fillers 300 are seatedly coupled. The support plates 51 are located above the uppermost portion of the box B supported by the transporters 22, and accordingly, the cushioning member fillers 300 coupled to the support plates 51 are located above the uppermost portion of the box B. As shown in FIG. 5, if a pair of support plates 51 is located on the robot support frame 50, while having a distance difference in a transport direction of the Y-axis, the two cushioning member fillers 300 are coupled to the two support plates 51.

Each cushioning member filler 300 picks up the cushioning member discharged from the outlet of the cushioning member maker 200 to a cushioning member tray 210 and fills the cushioning member to the specific position within the box B.

Each cushioning member filler 300 performs 3-axis motions with respect to the X, Y and Z-axes, and in FIG. 5, a Cartesian coordinate robot is used as the cushioning member filler 300. Each cushioning member filler 300 includes a first moving member 310 coupled to the support plate 51 and extending along the X-axis, a second moving member 320 coupled to the first moving member 310 and reciprocating along the X-axis through the first moving member 310, a third moving member 330 coupled to the second moving member 320 and extending along the Z-axis, and a gripper 340 coupled to the third moving member 330 and moving along the Y-axis through the third moving member 330. The gripper 340 serves to perform the pickup and filling operations for the cushioning member.

If the pickup operation for the cushioning member is performed through the cushioning member filler 300, the first moving member 310, the second moving member 320, and the third moving member 330 are controlled using the three-dimensional coordinates mapped to a predetermined pickup position to allow the gripper 340 to move to the predetermined pickup position. The pickup position is the foremost position of the cushioning member tray 210, and the cushioning member filler 300 fills the cushioning members loaded on the cushioning member tray 210 into the box B sequentially according to the first in and first out rule. A given portion of the cushioning member tray 210 from the outlet of the cushioning member maker 200 to the pickup position is inclined downward.

If the filling operation for the cushioning member is performed through the cushioning member filler 300, the first moving member 310, the second moving member 320, and the third moving member 330 are controlled using the three-dimensional coordinates representing the filling position to allow the gripper 340 to move to the filling position required by the controller 400.

The gripper 340 includes a body 341 coupled to the third moving member 330, a motor 342 coupled to the body 341 and having the Z-axis as a rotational axis, and a holder 343 coupled to the rotational axis of the motor 342.

For example, the holder 343 suckingly operates to generate a sucking force at the pickup position so that it picks up the cushioning member, and contrarily, the holder 343 releases the sucking force from the cushioning member so that it completes the filling operation of the cushioning member into the box B. The gripper 340 allows the holder 343 to generate the sucking force corresponding to the size of the cushioning member as a current filling object according to a cushioning member filling schedule as will be discussed later. In specific, the sucking force generated from the holder 343 in a process where the cushioning member with a relative large size is picked up and then filled into the box B is stronger than the sucking force generated from the holder 343 in a process where the cushioning member with a relative small size is picked up and then filled into the box B, and the intensities of the sucking forces may be predetermined according to the sizes of the cushioning members. For another example, the holder 343 operates like clips so that it pressurizingly picks up two portions of the cushioning member at the pickup position and releases the pressurization at the filling position to thus complete the filling operation of the cushioning member into the box B.

Further, in FIG. 5, the cushioning member fillers 300 are the Cartesian coordinate robots, but they may not be limited thereto. For example, only if they perform linear movements and/or rotational movements in the directions of the X, Y and Z-axes in the three-dimensional space, they may be cylindrical type robots, Selective Compliance Assembly Robot Arms (SCARA), and the like, without being limited in types thereof.

FIG. 6 is a perspective view showing an example of the remaining space acquired using the box space information according to the present invention, and FIGS. 7 and 8 are views showing scheduling processes of making and filling the cushioning members for the remaining space of the box having a constant underside height.

FIG. 6 is a perspective view showing the box B into which a set of goods G1 is accommodated. As shown in FIG. 6, a difference between the width of the set of goods G1 and the width of the box B is less than an allowable value, a difference between the length of the set of goods G1 and the length of the box B is less than an allowable value, a height of the set of goods G1 is less than the height of the box B, and the loading space 620 occupied by the set of goods G1 is a rectangular parallelepiped. The allowable value is a minimum width or length of the cushioning member made by the cushioning member maker 200. In FIG. 6, the set of goods G1 includes only the single goods with the shape of the rectangular parallelepiped or two or more goods having the same height as each other.

The controller 400 compares the first space information about the entire space 610 of the box B having the set of goods G1 accommodated thereinto with the second space information about the loading space 620 occupied by the set of goods G1 to produce the third space information about the remaining space 630 of the box B. The remaining space 630 is the space that remains by removing the loading space 620 from the entire space 610 so that the cushioning members have to be filled in the remaining space 630. If the loading space 620 of the set of goods G1 is provided, as shown in FIG. 6, the remaining space 630 is considered as a single rectangular parallelepiped located on top of the loading space 620.

Referring to FIG. 7, the controller 400 determines the size Si of the cushioning member to be filled into the remaining space 630, based on the width and length of the remaining space 630 having the shape of the rectangular parallelepiped, and then determines the number of cushioning members to be filled into the remaining space 630, based on the height $H_1$ of the remaining space 630.

If differences between the width and length of the cushioning member having a single size or any one size Si of the plurality of sizes made by the cushioning member maker 200 and the width and length of the section vertical to the Z-axis of the remaining space 630 are less than or equal to the allowable values, the controller 400 compares the height HM of the cushioning member with the corresponding size Si with the height $H_1$ of the remaining space 630 and thus calculates the total number of cushioning members to be filled into the remaining space 630. In this case, the height $H_M$ of the cushioning member with the corresponding size Si, the height $H_1$ of the remaining space 630, and the total number of cushioning members satisfy the following conditions, $$B \times (n+1) > A \geq B \times n \qquad \text{[Condition]}$$

The reference symbol A represents the height $H_1$ of the remaining space 630, B the height $H_M$ of the cushioning member with the corresponding size Si, and n the total number of cushioning members. For example, if the height $H_1$ of the remaining space 630 is 20 cm and the height $H_M$ of the cushioning member with the corresponding size Si is 4 cm, the number of cushioning members to be filled into the remaining space 630 is five. For another example, if the height $H_1$ of the remaining space 630 is 18 cm and the height $H_M$ of the cushioning member with the corresponding size Si is 4 cm, the number of cushioning members to be filled into the remaining space 630 is four. FIG. 7 shows a state in which the n is five, that is, a state in which five cushioning members are laminated onto top of one another in the remaining space 630.

If differences between the widths and lengths of the cushioning members having the plurality of sizes made by the cushioning member maker 200 and the width and length of the section (the X-Y plane) of the remaining space 630 are not less than or not equal to the allowable values, the controller 400 divides the remaining space 630 into two or more vertical spaces vertical to top of the box B and determines the total number of cushioning members to be filled into the plurality of vertical spaces. In this case, each vertical space has the section vertical to the Z-axis, and the sections (the X-Y planes) of the two or more vertical spaces have widths and lengths equal to one another or different from one another.

As shown in FIG. 8, the controller 400 divides the remaining space 630 into two rectangular parallelepiped vertical spaces 631 and 632 with the same cut surfaces vertical to the Z-axis. Further, the controller 400 determines the size Sj that has the width and length less than or equal to the width and length of the corresponding cut surface and has a minimum difference from the corresponding cut surface and then determines the number of cushioning members to be fillable into the corresponding vertical spaces, based on a distance between the underside and top of the plurality of vertical spaces 631 and 632, that is, the height H1 of the plurality of vertical spaces 631 and 632.

As shown in FIG. 8, the controller 400 produces a cushioning member making schedule and a cushioning member filling schedule for making five cushioning members for each vertical space, that is, 10 cushioning members having the same size and filling the cushioning members into the two vertical spaces 631 and 632. The controller 400 determines the order of filling the 10 cushioning members. According to an embodiment of the present invention, the order of filling the 10 cushioning members is determined so that filling of the cushioning members into any one vertical space is completed, and next, filling of the cushioning members into the other vertical space is performed. For example, as shown in FIG. 8, if it is assumed that 10 cushioning members are filled, cushioning member Nos. 1 to 5 are filled, and next, cushioning member Nos. 6 to 10 are filled. According to another embodiment of the present invention, the filling order mapped to the filling positions of the 10 cushioning members is determined so that the cushioning members are filled in the order of small Z-axis values of the filling positions. For example, the order of filling the 10 cushioning members is mapped to the filling positions so that cushioning member Nos. 1 and 6, cushioning member Nos. 2 and 7, cushioning member Nos. 3 and 8, cushioning member Nos. 4 and 9, and cushioning member Nos. 5 and 10 are filled in order. If the Z-axis values of any two filling positions are the same as each other, the order of filling the cushioning members according to the filling positions is determined in ascending or descending order according to the X-axis values or the Y-axis values of the respective filling positions.

In determining the filling positions of the cushioning members, the controller 400 further determines three-dimensional coordinates of the filling space and orthogonal rotations (filling directions) of the cushioning members on the corresponding three-dimensional coordinates. When FIGS. 7 and 8 are compared, the cushioning members to be filled into the remaining space 630 have the same size as one another, but the width direction of each cushioning member in FIG. 7 corresponds to the width direction of the remaining space 630, while the width direction of each cushioning member in FIG. 8 corresponds to the length direction of the remaining space 630. That is, even though the cushioning members have the same size as one another, it is determined whether they rotate orthogonally according to the space into which they are filled.

The gripper 340 rotates the holder 343 according to the filling direction included in the filling position of the cushioning member, moves the cushioning member to the three-dimensional coordinates included in the filling position, and then releases the pickup operation to complete the filling operation of the cushioning member.

Further, in FIG. 8, the remaining space 630 is divided into the two vertical spaces 631 and 632 having the same width, length, and volume, but without being limited thereto, the remaining space 630 may be divided into three or more vertical spaces that have the same width, length, and volume or are different in at least one of the width, length and volume.

FIG. 9 is a perspective view showing another example of the remaining space acquired using the box space information according to the present invention, and FIGS. 10 and 11 are views showing scheduling processes of making and filling cushioning members in the case where the remaining space is imaginarily divided into a plurality of vertical spaces having different underside heights.

FIG. 9 is a perspective view showing a box B in which a set of goods G2 is accommodated, while having a plurality of goods g11, g12, and g13 with different heights. For the convenience of description, it is assumed that differences between the widths of the three goods g11, g12, and g13 loaded in the box B and the width of the box B are less than an allowable value.

The controller 400 compares the first space information about the entire space 910 of the box B with the second space information about the loading space 920 occupied by the set of goods G2 to produce the third space information about the remaining space 630 of the box B.

As shown in FIG. 9, in the case where a height of the loading space 920 of the set of goods G2 is not constant, the controller 400 imaginarily divides the remaining space 930 into three vertical spaces 931, 932, and 933 disposed close to one another, based on heights H11, H12, and H13 by area of the loading space 920.

In specific, the controller 400 processes the second space information to search height distributions of tops (the undersides of the remaining space 930) of the loading space 920 according to at least one of the X-axis and the Y-axis, and next, the controller 400 repeats a process of setting imaginary boundaries that have height differences greater than or equal to a reference value, are parallel to the Z-axis, vertical to one of the X-axis and the Y-axis, and parallel to the other axis, so that the remaining space 930 is divided into the plurality of vertical spaces.

Referring to FIG. 10, the three vertical spaces 931, 932, and 933 are the spaces obtained by dividing the remaining space 930, while using two boundaries 901 and 902 (parallel to the X-Z plane) identified in the case where the height changes on top of the loading space 920 are searched along the Y-axis from a specific point of the front corner of the box B as a starting point. The boundary 901 between the vertical space 931 and the vertical space 932 is set through a difference between the height H11 of the goods g11 and the height H12 of the goods g12, and the boundary 902 between the vertical space 932 and the vertical space 933 is set through a difference between the height H12 of the goods g12 and the height H13 of the goods g13. That is, the vertical space 931 and the vertical space 932 are imaginarily divided through the boundary 901, and the vertical space 932 and the vertical space 933 are imaginarily divided through the boundary 902.

The controller 400 produces cushioning member making and filling schedules for the plurality of vertical spaces 931, 932, and 933 of the remaining space 930. In specific, the controller 400 applies space identification (ID) numbers to the plurality of vertical spaces 931, 932, and 933 in arbitrary or given order. For example, when it is assumed that a specific point of the box B is a starting point, the highest space ID number is applied to any one of the plurality of vertical spaces 931, 932, and 933 having the smallest X-axis value of center coordinates thereof, and if the X-axis values of the center coordinates of any two vertical spaces are the same as each other, the highest space ID number is applied to any one of the plurality of vertical spaces having the smallest Y-axis value of center coordinates thereof. As shown in FIG. 10, the X-axis values of the center coordinates of the three vertical spaces 931, 932, and 933 are the same as one another, and in this case, the highest space ID number is applied to the vertical space 931, and the lowest space ID number is applied to the vertical space 933 according to the Y-axis values of center coordinates of the three vertical spaces 931, 932, and 933.

The controller 400 determines the sizes of cushioning members corresponding to the sections (that is, the widths and lengths) of the plurality of vertical spaces 931, 932, and 933 and then determines the number of cushioning members to be filled into the corresponding vertical spaces, based on the heights of the corresponding vertical spaces. Additionally, the controller 400 determines the filling order and positions of the cushioning members to be filled into the plurality of vertical spaces.

The filling positions determined with respect to the arbitrary vertical spaces include three-dimensional coordinates, and the X and Y values of each filling position are the same as on the center coordinates of the corresponding vertical space. Further, if a plurality of cushioning members are filled into the arbitrary vertical space, the Z value of the filling position of each cushioning member is set as the value obtained by the following expression.

$$Z_P = Z_L + \{H_M \times m\} \quad \text{⟨Expression⟩}$$

In the expression, $Z_P$ represents the underside height of the vertical space into which the cushioning members are filled, $H_M$ a height of the cushioning members filled, m the filling order of the cushioning members into the vertical space, and $Z_L$ the Z value of the filling position of the cushioning member. The underside height of the vertical space is a Z-axis distance from the underside of the box B to the underside of the corresponding vertical space.

In FIG. 10, it is determined that cushioning member Nos. 1 to 3 having the same size SA are made and filled into the vertical space 931, cushioning member Nos. 4 to 8 having the same size SB are made and filled into the vertical space 932, and cushioning member Nos. 9 to 12 having the same size SC are made and filled into the vertical space 933.

<First Determination Method in Order of Making and Filling Cushioning Members: Space Priority>

The controller 400 produces cushioning member making works according to the plurality of vertical spaces. The cushioning member making works produced according to the plurality of vertical spaces are cushioning member making commands for the cushioning member maker 200, which include the space ID numbers of the corresponding vertical spaces, the sizes of cushioning members corresponding to the corresponding vertical spaces, and the total number of cushioning members to be filled into the corresponding vertical spaces.

If the remaining space 930 is divided into the plurality of vertical spaces 931, 932, and 933, a plurality of cushioning member making works are produced. The controller 400 produces a cushioning member making schedule that arranges the plurality of cushioning member making works produced according to the plurality of vertical spaces, based on the order of the space ID numbers of the plurality of vertical spaces 931, 932, and 933, and transmits the arranged works to the cushioning member maker 200. The cushioning member maker 200 makes the cushioning members to be filled into the plurality of vertical spaces sequentially according to the cushioning member making schedule. For example, the cushioning member maker 200 makes three cushioning members with the size SA determined with respect to the vertical space 931 to which the first priority space ID number is applied, five cushioning members with the size SB determined with respect to the vertical space 932 to which the second priority space ID number is applied, and four cushioning members with the size Sc determined with respect to the vertical space 933 to which the last priority space ID number is applied, thereby completing the making process based on the cushioning member making schedule. In this case, total 12 cushioning members are made sequentially in order of the cushioning member Nos. 1 to 12.

The controller 400 produces cushioning member filling works according to the plurality of vertical spaces, correspondingly to the cushioning member making works according to the plurality of vertical spaces. The cushioning member filling works produced according to the plurality of vertical spaces are cushioning member filling commands for the cushioning member filler 300, which include the space ID numbers of the corresponding vertical spaces, the reference heights $Z_L$ corresponding to the corresponding vertical spaces, and the total number of cushioning members to be filled into the corresponding vertical spaces. Otherwise, the cushioning member filling works produced according to the plurality of vertical spaces are cushioning member filling commands for the cushioning member filler 300, which include the space ID numbers of the corresponding vertical spaces, the total number of cushioning members to be filled into the corresponding vertical spaces, and the filling positions of the cushioning members to be filled into the corresponding vertical spaces.

In the same manner as the cushioning member making operations, if the remaining space 930 is divided into the plurality of vertical spaces 931, 932, and 933, a plurality of cushioning member filling works corresponding one-on-one to the plurality of vertical spaces 931, 932, and 933 are produced. The controller 400 produces a cushioning member filling schedule that arranges the plurality of cushioning member filling works produced according to the plurality of vertical spaces, based on the order of the space ID numbers of the plurality of vertical spaces, and transmits the arranged cushioning member filling works to the cushioning member filler 300.

The cushioning member filler 300 fills the cushioning members made and received from the cushioning member maker 200 sequentially into the remaining space according to the cushioning member filling schedule.

The cushioning member filler 300 fills three cushioning members (cushioning member Nos. 1 to 3) with the size SA into the vertical space 931 to which the first priority space ID number is applied, five cushioning members (cushioning member Nos. 5 to 8) with the size SB into the vertical space 932 to which the second priority space ID number is applied, and four cushioning members (cushioning member Nos. 9 to 12) with the size Sc into the vertical space 933 to which the last priority space ID number is applied.

If the plurality of cushioning members are filled into the arbitrary vertical spaces, accordingly, the controller 400 determines the filling position of the cushioning member currently filled and the filling position of the cushioning member filled next time, while counting the number of cushioning members to be filled into the plurality of vertical spaces. For example, the three-dimensional coordinates of the filling position of the cushioning member to be filled at n-th time into the first vertical space are determined by the X and Y values of the center coordinates of the first vertical space and the Z value obtained through the Expression. Otherwise, the controller 400 fills the total number of cushioning members determined according to the plurality of vertical spaces into the corresponding vertical spaces sequentially, based on the filling positions in the filling order included in the cushioning member filling schedule.

<Second Determination Method in Order of Making and Filling Cushioning Members: Z-Axis Value Priority of Filling Position>

Unlike the above-mentioned first determination method in which the making and filling order of the cushioning members is based on the priorities of the space ID numbers applied to the plurality of vertical spaces, the controller 400 determines the making and filling order of the cushioning members, based on the Z values of the filling positions of the cushioning members.

In specific, as shown in FIG. 10, if it is needed to make and fill total 12 cushioning members including cushioning member Nos. 1 to 12 for the remaining space 930, the controller 400 arranges the Z-axis values of the filling positions in ascending order and thus determines the making and filling order of the 12 cushioning members. In specific, a relatively high priority making and filling order is assigned to the cushioning member with a relatively low height value (Z-axis value) of the filling position. In this case, the making order assigned to the arbitrary cushioning member is the same as the filling order assigned thereto. In specific, if k is a natural number less than or equal to 12, the making order assigned to the k-th cushioning member is the same as the filling order assigned to the k-th cushioning member. Accordingly, the cushioning member filling order of the cushioning member filler 300 corresponds to the cushioning member making order of the cushioning member maker 200. In specific, making and filling of the cushioning member No. 4 with the lowest Z-axis value of the filling position among the total 12 cushioning members are firstly performed, and making and filling of the cushioning member No. 3 with the highest Z-axis value of the filling position are lastly performed.

FIG. 11 is a plan view showing the box B in which the filling of the cushioning members into the remaining space as shown in FIGS. 9 and 10 is completed. Referring to FIG. 11, the X and Y coordinates (X3 and Y3) of the filling position of the cushioning member No. 3 lastly filled into the vertical space 931 are equal to the X and Y coordinates on the center of the vertical space 931.

Further, the X and Y coordinates (X8 and Y8) of the filling position of the cushioning member No. 8 lastly filled into the vertical space 932 are equal to the X and Y coordinates on the center of the vertical space 932. Furthermore, the X and Y coordinates (X12 and Y12) of the filling position of the cushioning member No. 12 lastly filled into the vertical space 933 are equal to the X and Y coordinates on the center of the vertical space 933. For the reference, the Z-axis values of the filling positions of the respective cushioning members are determined through the above-mentioned Expression.

Further, in FIGS. 10 and 11, it is assumed that the widths (X-axis sizes) of the three vertical spaces 931, 932, and 933 are the same, and accordingly, the widths of the cushioning members filled into the three vertical spaces 931, 932, and 933 are the same. However, the present invention may not be limited thereto. If the cushioning member maker 200 makes the cushioning members having a plurality of sizes, in specific, the controller 400 primarily sorts at least one size fillable into the corresponding vertical space from the plurality of sizes. If the sorted size is one, it is immediately determined. Contrarily, if the sorted size is one or more, any one size, which is minimized in a difference from the section of the corresponding vertical space, is selected.

FIG. 12 is a flowchart showing a cushioning member filling method according to the present invention.

Referring to FIG. 12, in step S1210, the controller 400 acquires the space information of the box B with the set of goods loaded therein through the sensor module 100. The space information of the box B includes first space information and second space information. The first space information is the information about the entire space of the box B. The second space information is the information about the loading space occupied by the set of goods in the entire space of the box B.

In step S1220, the controller 400 determines whether the set of goods is defectively loaded according to the space information of the box B. If the value of the step S1220 is 'No', the controller 400 performs step S1230. For example, if the height of the loading space exceeds the height of the entire space, it is determined that the set of goods is defectively loaded, and the value of the step S1220 is 'Yes'. If the value of the step S1220 is 'Yes', an alarmer 60 mounted on the sensor support frame 30 operates to notify a worker of a state where the set of goods is defectively loaded in the box B. Accordingly, the notified box B is removed by the worker before it is transported to the cushioning member filler 300, and next, the set of goods is re-arranged.

In the step S1230, the controller 400 produces a cushioning member making schedule and a cushioning member filling schedule according to the space information of the box B. The step S1230 will be explained in detail later with reference to FIG. 13.

In step S1240, the controller 400 controls the cushioning member maker 200 to make the cushioning members to be filled into the box B according to the cushioning member making schedule. In specific, the cushioning member maker 200 makes the cushioning members with the sizes mapped to the making order given in the cushioning member making schedule and discharges the made cushioning members to the cushioning member tray 210.

In step S1250, the controller 400 controls the cushioning member filler 300 to pick up the cushioning members received from the cushioning member maker 200 and thus fill the cushioning members into the box B according to the cushioning member filling schedule. In specific, the cushioning member filler 300 picks up the cushioning members discharged onto the cushioning member tray 210 and thus loads the cushioning members onto the filling positions given in the cushioning member filling schedule.

FIG. 13 is a flowchart showing a process of producing the cushioning member making schedule and the cushioning member filling schedule according to the present invention. The process of FIG. 13 corresponds to the step S1230 of FIG. 12.

Referring to FIG. 13, in step S1310, the controller 400 compares the first space information with the second space information to thus acquire third space information. The third space information is the information about the remaining space obtained by removing the loading space from the entire space of the box B.

In step S1320, the controller 400 determines whether there is a need to divide the remaining space into a plurality of vertical spaces according to the third space information. For one example, in the case where the underside of the remaining space is entirely constant, if a cushioning member with a given size capable of covering the section of the residual space (That is, a cushioning member having width and length less than allowable values in differences from the width and length of the remaining space) does not exist, the value of the step S1320 is outputted as 'Yes' (See FIGS. 6 and 8). For another example, if top of the loading space (the underside of the remaining space) is divided into areas (X and Y planes) having different heights, the value of the step S1320 is outputted as 'Yes' (See FIGS. 9 and 10). If the value of the step S1320 is outputted as 'No', the controller 400 performs step S1330. If the value of the step S1320 is outputted as 'Yes', the controller 400 performs step S1350.

In the step S1330, the controller 400 determines the size, total number, and filling positions of the cushioning members to be filled into the remaining space. The size of cushioning members is pre-mapped to the first space information. The filling positions of the cushioning members include the three-dimensional coordinates to which the cushioning members are filled and the orthogonal rotations of the cushioning members. If the total number of cushioning members is greater than or equal to 2, the X and Y coordinates of the filling positions of the two or more cushioning members correspond to the X and Y coordinates on the center of the box B or loading space, and only the Z-axis values of the three-dimensional coordinates of the filling positions of the two or more cushioning members are different from one another.

In step S1342, the controller 400 produces a cushioning member making schedule according to the determined size and total number of cushioning members. As mentioned above, if the remaining space is not divided into the plurality of vertical spaces, all of the cushioning members to be filled into the remaining space have the same size, and accordingly, the cushioning member making schedule includes just the size and number of the cushioning members.

In step S1344, the controller 400 produces a cushioning member filling schedule according to the determined filling positions of the cushioning members. The cushioning member filling schedule is the collection of filling positions arranged in ascending order according to the Z-axis values.

In the step S1350, the controller 400 imaginarily divides the remaining space into the plurality of vertical spaces. The plurality of vertical spaces are vertical with respect to top of the remaining space (open top of the box B). The number of vertical spaces divided in the remaining space and the arrangements of the plurality of vertical spaces are determined according to at least one of the section size of the remaining space and the heights by area of the underside of the remaining space. The controller 400 applies different space ID numbers to the plurality of vertical spaces.

In step S1360, the controller 400 determines the sizes, total number, and filling positions of cushioning members to be filled into the plurality of vertical spaces. The controller 400 determines the total number of cushioning members to be filled into the plurality of vertical spaces according to the underside and top heights of the plurality of vertical spaces.

The controller 400 determines the filling positions of the cushioning members according to the underside and top heights and the center coordinates of the plurality of vertical spaces. The filling positions of the cushioning members to be filled into the same vertical space are set to have the same X and Y coordinates and orthogonal rotations of the corresponding vertical space. If the total number of cushioning members is greater than or equal to 2, the X and Y coordinates of the filling positions of the two or more cushioning members correspond to the X and Y coordinates on the center of the corresponding vertical space, and only the Z-axis values of the three-dimensional coordinates of the filling positions of the two or more cushioning members are different from one another (See the Expression). The controller 400 determines the sizes of the cushioning members to be filled into the plurality of vertical spaces according to the widths and lengths of the plurality of vertical spaces. For one example, if it is possible that the cushioning members having a plurality of sizes are made through the cushioning member maker 200, the sizes of the cushioning members to be filled into the plurality of vertical spaces are the sizes that can be filled into the corresponding vertical spaces and maximize the occupation rates of the cushioning members (e.g., the ratios of the sectional areas of the cushioning members to the corresponding vertical spaces). For another example, the sizes of the cushioning members to be filled into the plurality of vertical spaces are the sizes that can be filled into the corresponding vertical spaces and have width and length differences from the width and length of the corresponding vertical spaces that are less than allowable values. The cushioning members with the same size as each other are filled into the same vertical space as each other.

In step S1372, the controller 400 arranges the making order of the cushioning members to be filled into the plurality of vertical spaces according to any one selected from the space priority and the filling position priority and thus produces the cushioning member making schedule.

For one example, under the space priority, the controller 400 produces making commands representing the sizes and total number of cushioning members determined for the plurality of vertical spaces, arranges the making commands corresponding to the plurality of vertical spaces according to the space ID numbers, and produces the cushioning member making schedule. In the case of the cushioning members to be filled into the same vertical space, the first priority making order is applied to the smallest height value (Z-axis value) of the filling position thereof, and in the case of the cushioning members to be filled into different vertical spaces, the first priority making order is applied to the cushioning members to be filled into the vertical space to which the first priority space ID number is applied.

For another example, under the filling position priority, the controller 400 arranges the sizes of cushioning members to be filled into the plurality of vertical spaces according to the height values of the filling positions of the cushioning members and produces the cushioning member making schedule. In the case of all of the cushioning members, the first priority making order is applied to the smallest height value of the filling position thereof.

In step S1374, the controller 400 arranges the filling order of the cushioning members to be filled into the plurality of vertical spaces according to any one selected from the space priority and the filling position priority and thus produces the cushioning member filling schedule.

For one example, under the space priority, the controller 400 produces filling commands representing the total number and filling positions of cushioning members determined for the plurality of vertical spaces, arranges the filling commands corresponding to the plurality of vertical spaces according to the space ID numbers, and produces the cushioning member filling schedule.

For another example, under the filling position priority, the controller 400 arranges the filling positions of the cushioning members to be filled into the plurality of vertical spaces according to the height values of the filling positions of the cushioning members and produces the cushioning member filling schedule.

The disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure.

Further, the components for executing the technical characteristics of the present invention, which are included in the block diagrams and flowchart of the attached drawings, indicate the logical boundaries among them. According to the software or hardware embodiments, however, the components and their functions are executed in the form of independent software modules, monolithic software structures, codes, services, and a combination thereof and are recorded in a medium executable in a computer having a processor capable of implementing stored program codes, commands, and the like. Therefore, it should be appreciated that the embodiments are within the scope of the present invention.

Although specific embodiments have been illustrated and described herein, it will be appreciated by those of ordinary skill in the art that any specific arrangement of software, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The operations are indicated in the drawings in specific steps, but it should be understood that the illustrated specific steps, the sequential steps, or all the specific steps are not necessarily carried out so as to accomplish desired results. In arbitrary environments, multitasking and parallel processing are more advantageous. Furthermore, it should be understood that the classification of the various components is not needed for all the embodiments of the present invention and that the described components are integrated as a single software product or packaged as a plurality of software products.

EXPLANATIONS OF REFERENCE NUMERALS

| | |
|---|---|
| 10: Cushioning member filling apparatus | |
| 100: Sensor module | 110: First sensor |
| 120: Second sensor | 130: Third sensor |
| 200: Cushioning member maker | 300: Cushioning member filler |
| 400: Controller | |

The invention claimed is:

1. A cushioning member filling apparatus comprising:

a sensor module configured to acquire box space information having first space information about the entire space of a box with a set of goods loaded therein and second space information about a loading space occupied by the set of goods in the entire space of the box;

a controller configured to produce a cushioning member making schedule and a cushioning member filling schedule according to the acquired box space information;

a cushioning member maker configured to make cushioning members to be filled into the box according to the cushioning member making schedule; and a cushioning member filler configured to pick up the cushioning members received from the cushioning member maker and fill the cushioning members into the box according to the cushioning member filling schedule, wherein the controller compares the first space information with the second space information to acquire third space information about a remaining space obtained by removing the loading space from the entire space and produces the cushioning member making schedule and the cushioning member filling schedule according to the acquired third space information, wherein the controller is configured to imaginarily divide the remaining space into a plurality of vertical spaces that are vertical relative to a top surface of the remaining space according to the third space information and determine sizes, total numbers, and filling positions of the cushioning members to be filled into the plurality of vertical spaces, wherein the controller is configured to arrange making commands representing the sizes and total numbers of the cushioning members determined for the plurality of vertical spaces according to space identification (ID) numbers assigned to the plurality of vertical spaces to thus produce the cushioning member making schedule.

2. The apparatus according to claim 1, wherein the controller produces the cushioning member making schedule according to the determined sizes and total numbers of the cushioning members and the cushioning member filling schedule according to the determined filling positions of the cushioning members.

3. The apparatus according to claim 1, wherein the controller determines the total numbers of the cushioning members to be filled into the plurality of vertical spaces according to bottom heights and top heights of the plurality of vertical spaces, determines the filling positions of the cushioning members according to the bottom heights and the top heights and center coordinates of the plurality of vertical spaces, and determines the sizes of the cushioning members to be filled into the plurality of vertical spaces according to widths and lengths of the plurality of vertical spaces.

4. The apparatus according to claim 1, wherein the controller arranges filling commands representing the total numbers and filling positions of the cushioning members determined for the plurality of vertical spaces according to the space ID numbers assigned to the plurality of vertical spaces to thus produce the cushioning member filling schedule.

5. The apparatus according to claim 1, wherein the controller arranges the sizes of the cushioning members to be filled into the plurality of vertical spaces according to height values corresponding to the filling positions of the cushioning members into the plurality of vertical spaces to produce the cushioning member making schedule.

6. The apparatus according to claim 1, wherein the controller arranges the filling positions of the cushioning members to be filled into the plurality of vertical spaces according to height values corresponding to the filling positions of the cushioning members into the plurality of vertical spaces to produce the cushioning member filling schedule.

7. The apparatus according to claim 1, wherein the cushioning members are made of eco-friendly materials and have a plurality of sizes different in at least one of length, width and height.

8. The apparatus according to claim 1, wherein the sensor module comprises:

a first sensor configured to recognize box codes marked on the outer surface of the box and thus acquire the first space information; and a second sensor configured to capture an image of the interior of the box and thus acquire the second space information.

9. A cushioning member filling method comprising the steps of:

acquiring box space information having first space information about the entire space of a box with a set of goods loaded therein and second space information about a loading space occupied by the set of goods in the entire space of the box;

producing a cushioning member making schedule and a cushioning member filling schedule according to the acquired box space information;

controlling a cushioning member maker to make cushioning members to be filled into the box according to the cushioning member making schedule; and controlling a cushioning member filler to pick up the cushioning members received from the cushioning member maker and thus fill the cushioning members into the box according to the cushioning member filling schedule, wherein the step of producing the cushioning member making schedule and the cushioning member filling schedule comprises the steps of:

comparing the first space information with the second space information to acquire third space information about a remaining space obtained by removing the loading space from the entire space;

imaginarily dividing the remaining space into a plurality of vertical spaces that are vertical relative to a top surface of the remaining space; and determining sizes, total numbers, and filling positions of cushioning members to be filled into the plurality of vertical spaces, wherein the step of producing the cushioning member making schedule and the cushioning member filling schedule further comprises the steps of:

arranging making commands representing the sizes and the total numbers of cushioning members determined for the plurality of vertical spaces according to space ID numbers assigned to the plurality of vertical spaces to thus produce the cushioning member making schedule; and arranging filling commands representing the total numbers and the filling positions of cushioning members determined for the plurality of vertical spaces according to the space ID numbers assigned to the plurality of vertical spaces to thus produce the cushioning member filling schedule.

10. The method according to claim 9, wherein the step of producing the cushioning member making schedule and the cushioning member filling schedule comprises the steps of:

producing the cushioning member making schedule according to the determined sizes and total numbers of the cushioning members; and producing the cushioning member filling schedule according to the determined filling positions of the cushioning members.

11. The method according to claim 9, wherein the step of producing the cushioning member making schedule and the cushioning member filling schedule further comprises the steps of:

arranging the sizes of the cushioning members to be filled into the plurality of vertical spaces according to height values corresponding to the filling positions of the cushioning members into the plurality of vertical spaces to produce the cushioning member making schedule; and arranging the filling positions of the cushioning members to be filled into the plurality of vertical spaces according to the height values corresponding to the filling positions of the cushioning members into the plurality of vertical spaces to produce the cushioning member filling schedule.

* * * * *